US009702267B2

(12) United States Patent
Gekht et al.

(10) Patent No.: US 9,702,267 B2
(45) Date of Patent: Jul. 11, 2017

(54) ENGINE STRUCTURE ASSEMBLY PROCEDURE

(71) Applicant: PRATT & WHITNEY CANADA CORP., Longueuil (CA)

(72) Inventors: Eugene Gekht, Brossard (CA); Patrice Remy, St. Hubert (CA); Danny Mills, Chateauguay (CA)

(73) Assignee: PRATT & WHITNEY CANADA CORP., Longueuil, Quebec ( * ) Notice: Subject to any disclaimer, the term of this patent is extended or adjusted under 35 U.S.C. 154(b) by 451 days.

(21) Appl. No.: 14/514,471

(22) Filed: Oct. 15, 2014

(65) Prior Publication Data

US 2016/0107276 A1 Apr. 21, 2016

(51) Int. Cl.
*F01D 25/16* (2006.01)

(52) U.S. Cl.
CPC ..... *F01D 25/162* (2013.01); *F05D 2230/61* (2013.01)

(58) Field of Classification Search
CPC ..... F01D 25/162; F05D 2230/61
See application file for complete search history.

(56) References Cited

U.S. PATENT DOCUMENTS

| | | | |
|---|---|---|---|
| 5,545,010 | A | 8/1996 | Cederwall et al. |
| 7,032,279 | B2 | 4/2006 | McCarvill et al. |
| 7,735,222 | B2 | 6/2010 | Sherlock et al. |
| 7,766,726 | B2 | 8/2010 | Sherlock et al. |
| 8,316,523 | B2 | 11/2012 | Durocher et al. |
| 8,430,627 | B2 | 4/2013 | Ruiz et al. |
| 8,713,775 | B2 | 5/2014 | Zhang et al. |
| 8,726,502 | B2 | 5/2014 | Clark et al. |
| 2004/0074093 | A1 | 4/2004 | McCarvill et al. |
| 2006/0010852 | A1 | 1/2006 | Gekht et al. |
| 2006/0168809 | A1 | 8/2006 | McCarvill et al. |
| 2007/0140845 | A1 | 6/2007 | Marke et al. |
| 2008/0115648 | A1 | 5/2008 | Sherlock et al. |
| 2012/0317771 | A1 | 12/2012 | Zhang et al. |
| 2013/0199008 | A1 | 8/2013 | Clark et al. |
| 2013/0232792 | A1 | 9/2013 | Quinones et al. |

*Primary Examiner* — Moshe Wilensky
(74) *Attorney, Agent, or Firm* — Norton Rose Fulbright Canada

(57) ABSTRACT

A method for centering an engine structure such as a bearing housing is provided which may be used for example, during assembly of a mid turbine frame or other engine case structure. The method according to one embodiment may include machining spokes with an outer case of the mid turbine frame in situ to eliminate stack-up and then applying the retaining device to retain the spokes with respect to the outer case, thereby assuring the co-axial relationship between the outer case and the bearing housing supported within the mid turbine frame.

19 Claims, 5 Drawing Sheets

ENGINE STRUCTURE ASSEMBLY PROCEDURE

TECHNICAL FIELD

The application relates generally to gas turbine engines, and more particularly, to a method for centering engine structure for such engines.

BACKGROUND OF THE ART

Assembly stack-up may affect the concentricity of engine structures such as the concentricity of the bearing housings with respect to the outer case of a gas turbine engine assembly, which could bring the turbine rotors off center relative to stationary components such as turbine shrouds, thereby directly affecting blade tip and secondary air seal clearance, among other things. Complicated steps have been employed, for example in a mid-turbine frame (MTF) assembly procedure, including stand-off measurements, component numbering, difference calculations, etc. in order to control the concentricity of a bearing housing with respect to an outer case of the MTF.

Accordingly, there is a need to provide an improved method for centering turbine engine cases.

SUMMARY

In one aspect, the described subject matter provides a method for making an assembly of a gas turbine engine structure, the assembly including at least co-axially positioned annular outer and inner cases interconnected by a plurality of circumferentially spaced load transfer members extending radially between the outer and inner cases, the method comprising: (1) substantially forming the assembly of the gas turbine engine structure on the fixture by positioning the outer case and the inner case co axially with each other on a fixture and affixing a radially-inner end of each of the load transfer members to the inner case while letting a radially-outer end portion of each of the load transfer members extend radially through one of a plurality circumferentially spaced openings defined in the outer case; (2) creating a plurality of commonly machined surfaces each provided by a machined end surface of one of the load transfer members flush with and surrounded by a machined surface of the outer case, by temporarily securing the substantially formed assembly on the fixture and machining the radially-outer end portion of the respective load transfer members exposed through the respective openings of the outer case and machining an area of the outer case surrounding each of the radially-outer ends; and then (3) securing the co-axial position of the outer and inner cases before the assembly is removed from the fixture by attaching a retaining device to the outer case to retain the respective commonly machined surfaces in place.

In another aspect, the described subject matter provides a method for centering a bearing housing during a mid-turbine frame (MTF) assembly procedure, the method comprising: (1) forming a substantial MTF assembly on the fixture by positioning at least an outer case, an inner case, a plurality of radial spokes and the bearing housing on a fixture, attaching the bearing housing to and supporting the bearing housing in the inner case, affixing a radially-inner end of each of the radial spokes to the inner case while letting a radially-outer end portion of each of the spokes extend radially through one of a plurality circumferentially spaced openings defined in the outer case to expose an outer end of the radially-outer end portion through the respective openings, and positioning the outer case co-axially with the bearing housing; (2) creating a plurality of commonly machined surfaces each formed with a machined end surface of one of the radial spokes flush with and surrounded by a machined surface of the outer case by temporarily securing the substantial MTF assembly on the fixture and machining the radially-outer end of the respective radial spokes exposed through the respective openings of the outer case and machining an area of the outer case surrounding each of the radially-outer ends; and (3) securing the co-axial position of the outer case and the bearing housing to form the MTF for installation in a gas turbine engine by attaching a retaining device to the outer case to retain the respective commonly machined surfaces in place when the substantial MTF assembly is on the fixture.

Further details of these and other aspects of the described subject matter will be apparent from the detailed description and drawings included below.

DESCRIPTION OF THE DRAWINGS

Reference is now made to the accompanying drawings in which.

It will be noted that throughout the appended drawings, like features are identified by like reference numerals.

DETAILED DESCRIPTION

Figure 1:
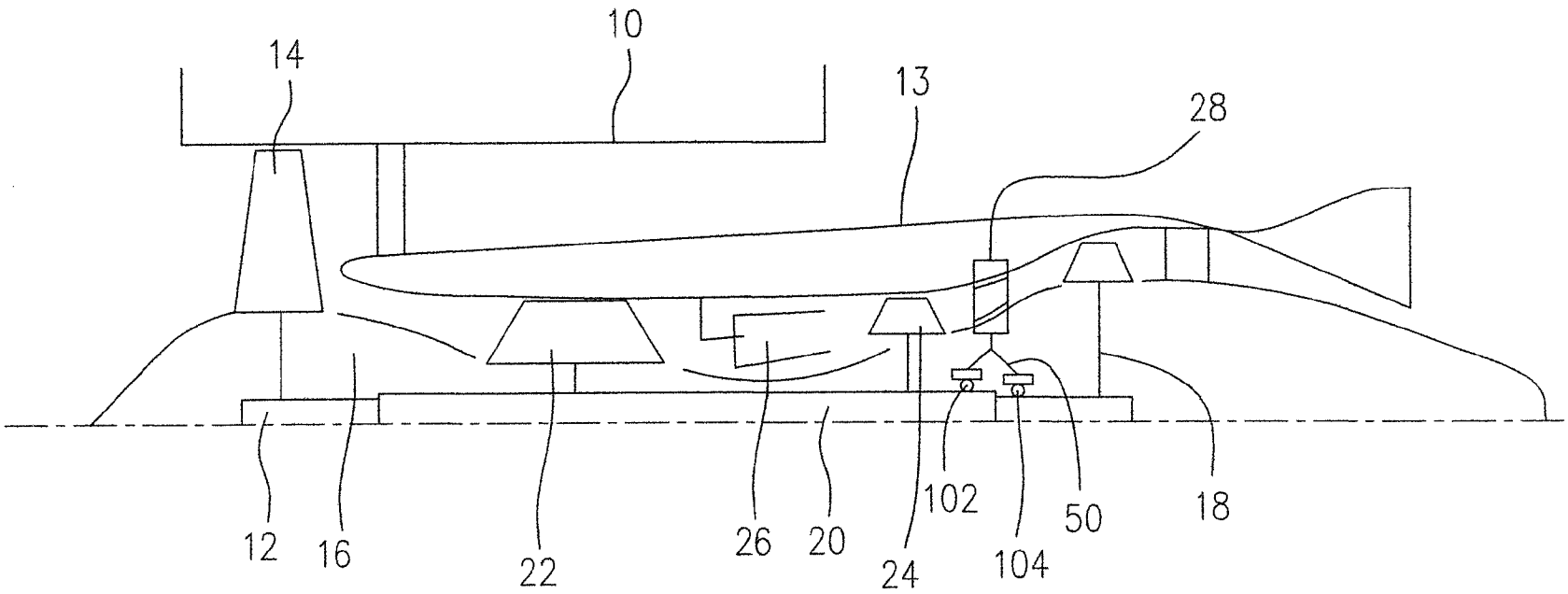
FIG. 1 is a schematic side cross-sectional view of a gas turbine engine as an example illustrating application of the described subject matter.

Referring to FIG. 1, a turbofan gas turbine engine includes, for example, a fan case 10, an engine core case 13, a low pressure spool assembly which includes a fan assembly 14, a low pressure compressor assembly 16 and a low pressure turbine assembly 18 connected by a shaft 12, and a high pressure spool assembly which includes a high pressure compressor assembly 22 and a high pressure turbine assembly 24 connected by a turbine shaft 20. The core casing 13 surrounds the low and high pressure spool assemblies to define a main fluid path (not numbered) therethrough. In the main fluid path there is provided a combustor 26 to generate combustion gases which power the high pressure turbine assembly 24 and the low pressure turbine assembly 18. A portion of the core case 13 in this exemplary engine, includes a mid turbine frame (MTF) 28 disposed generally between the high pressure turbine assembly 24 and the low pressure turbine assembly 18 and supports a bearing housing 50 containing, for example, bearings 102 and 104 around the respective shafts 20 and 12.

The terms "axial", "radial" and "circumferential" used for various components below are defined with respect to the main engine axis shown but not numbered in FIG. 1.

Referring to FIGS. 1-6, the MTF 28 according to one embodiment may include an annular outer case 30 which has mounting flanges (not shown) at both ends with mounting holes in the mounting flanges for connection to other components (not shown) which cooperate with the outer case 30 to provide the core casing 13 of the engine. The outer case 30 may thus be a part of the core casing 13. An annular inner case 34 may be axially disposed within the outer case 30 and a plurality of circumferentially spaced load transfer members 36 (at least three spokes) may extend radially between and interconnect the outer case 30 and the inner case 34. The inner case 34 may generally include an annular axial wall 38 and an annular radial wall 33. The annular radial wall 33 may be provided with an annular axial flange which is concentric about an axis (not shown) of the inner case 34. The bearing housing 50 (schematically shown in FIGS. 1, 2 and 3) may be mounted to the annular axial flange of the annular radial wall 33 in a suitable fashion such as by fasteners (not shown). The bearing housing 50 may accommodate one or more main bearing assemblies therein, such as bearings 102 and 104. The bearing housing 50 must be centered with the annular outer case 30 which will be further described in reference to an MTF assembly procedure described hereinafter.

The MTF 28 may be further provided with an inter-turbine duct (ITD) 110 positioned radially between the outer and inner cases 30, 34, for directing combustion gases to flow through the MTF 28. The ITD 110 may include, for example, an annular duct 112 which has an annular outer duct wall 114 and an annular inner duct wall 116. An annular path 136 is defined between the outer and inner duct walls 114, 116 to direct the combustion gas flow.

The annular duct 112 may further include a plurality of circumferentially-spaced and radially-extending hollow struts 118 (at least three struts) interconnecting the outer and inner duct walls. A plurality of openings 120, 122 may be defined in the respective outer and inner duct walls 114, 116 and may be aligned with the respective hollow struts 118 to allow the respective load transfer members 36 to radially extend through the hollow struts 118. The ITD 110 may be supported and retained within the outer case 30.

A fixture which is schematically illustrated and indicated by numeral 32 (see FIG. 3) according to one embodiment, may be provided for an MTF assembly procedure in order to ensure the bearing housing 50 is centered with respect to the outer case 30. The fixture 32 may have positioning members (not shown) to hold the bearing housing 50 or the inner case 34 and the outer case 30 in position such that the co-axial relationship between the outer case 30 and the bearing housing 50 is assured in the MTF assembly procedure.

Referring to FIGS. 1-4, a method for centering the bearing housing 50 in the MTF assembly procedure using the fixture 32 is described according to one embodiment. The respective MTF components including at least the outer and inner cases 30, 34, the plurality of load transfer members 36 and the bearing housing 50, are positioned on the fixture 32 to form a substantial MTF assembly which is not completed for installation in the engine, but is only held together on and by the fixture 32. In the substantial MTF assembly, the bearing housing 50 is attached to and supported on the inner case 34. The plurality of load transfer members 36 according to one embodiment may include a plurality of spokes 36*a*, each having a radially-inner end 39 and a radially-outer end 40 thereof (see FIG. 3). The radially-inner ends 39 of the respective spokes 36*a* may be affixed to the inner case 34, for example by fasteners (not numbered), and a radially-outer end portion 42 immediately adjacent the radially outer end 40 of the respective spokes 36*a* may extend radially through a plurality of circumferentially spaced openings 44 defined in an annular axial wall 38 of the outer case 30 (see FIG. 3).

The substantial MTF assembly held on the fixture 32 may further include the ITD 110 which is positioned radially between the outer and inner cases 30, 34 such that the spokes 36*a* extend radially through the respective hollow struts 118 and the plurality of openings 120, 122 defined in the respective outer and inner duct walls 114, 116.

The outer case 30 of the substantial MTF assembly held on the fixture 32, may not be secured to the respective spokes 36*a* while the bearing housing 50 and the spokes 36*a* are affixed to the inner case 34 such that the outer case 30 can be adjusted or directly positioned by the fixture 32 in a position coaxial with the bearing housing 50. Such a coaxial relationship between the outer case 30 and the bearing housing 50 may be temporarily secured by the fixture 32.

The detailed steps for formation of the substantial MTF assembly on the fixture may vary according to particular connection features of the respective components. For example, the ITD 110 may be configured with a plurality of circumferential segments to allow the respective segments to be radially inwardly placed in position to form the ITD 110 while allowing the respective radially-outwardly extending spokes 36*a* (which may or may not already be affixed to the inner case 34) to radially extend through the ITD 110. Such various detailed assembly steps are well known in the industry and will not be exhaustively described herein.

The ITD 110 may be supported and retained within the outer case 30, for example by a retaining ring 46 to retain the engagement between the outer duct wall 114 and the outer case 30.

Figure 3:
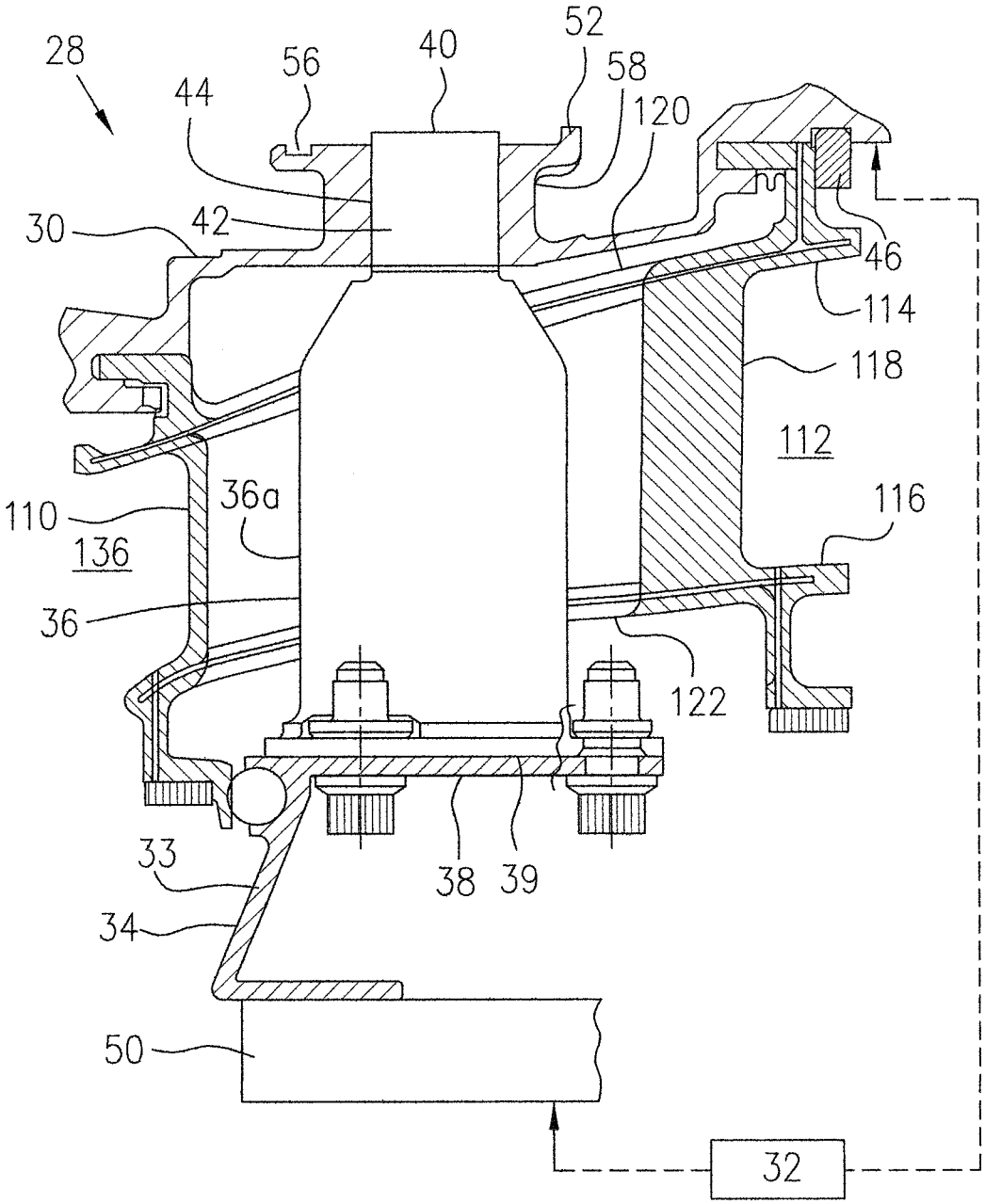
FIG. 3 is a substantial assembly of the mid turbine frame of FIG. 2 (without a retaining device thereon), held in position in a fixture used in a mid turbine frame assembly procedure.

With the substantial MTF assembly being retained on the fixture 32, the radially-outer end 40 of the radially-outer end portion 42 (the spoke 36*a*) may be exposed through the respective openings 44 in the outer case 30. The radially-outer end 40 of the spokes 36*a* may slightly project from an entrance (not numbered) of the respective openings 44, as shown in FIG. 3 or may be slightly below and thus within the entrance of the respective openings 44, due to respective manufacturing tolerance stack up of the MTF components. A machining operation such as turning, grinding or milling operations may be applied to machine the radially-outer ends 40 of the respective spokes 36*a* together with an area of the outer case surrounding each of the radially-outer ends 40 and forming the entrance of each of the openings 44, to thereby create a plurality of commonly machined surfaces (not numbered). Each of the commonly machined surfaces is formed by a machined end surface 40*a* of one of the spokes 36*a* (also of the radially-outer end portion 42) flush with and surrounded by the machined surface 40*b* of the outer case 30 (see FIG. 4).

In a turning operation or a grinding operation the substantial MTF assembly retained on the fixture 32 may be rotated together with the fixture 32 about a rotational axis (not shown) which may or may not be superposed with the central axis (not shown) of the bearing housing 50 such that the plurality of commonly machined surfaces formed by the machined surfaces 40*a* and machined surfaces 40*b* define an annular axial plane about the rotational axis.

According to one embodiment employing such a turning or grinding operation, a retaining ring 48 may be placed around the outer case 30 and an annular inner axial surface (not numbered) of the retaining ring may be positioned to be in contact with all of the commonly machined surfaces formed by each combination of the respective machined surfaces 40*a* and machined surfaces 40*b* in order to prevent radial movement between the spokes 36*a* and the outer case 30, thereby securing the co-axial position of the outer case 30 and the bearing housing 50 to form a completed MTF 28 which can then be removed from the fixture 32 and is ready for installation in the gas turbine engine of FIG. 1.

Optionally, the outer case 30 may include a plurality of circumferentially spaced connecting bosses 58 projecting radially outwardly from the outer case 30. The openings 44 defined in the outer case 30 may extend radially through the respective connecting bosses 58. Therefore, a top of each boss 58 defines the entries of one of the openings 44 and defines the area surrounding the radially-outer end portion 42 of each spoke 36*a*. The bosses 58 and the radially-outer end portion 42 of the respective spokes 36*a* thereby provide the commonly machined surfaces formed by machined surfaces 40*a* and 40*b* after the machining operation.

Optionally, the connecting bosses 58 may each be provided with anti-rotation features such as a radial projection 52 engagable with a slot (not numbered) of the radial retaining ring 48 in order to prevent rotational movement of the radial retaining ring 48 with respect to the outer case 30.

Optionally, an axial retaining ring 54 according to a further embodiment may be provided immediately adjacent one axial side of the radial retaining ring 48 and may be engaged in a section of a circumferential groove 56 defined in the respective connecting bosses 58 to prevent the retaining ring 48 from accidentally slipping out of position during engine operation.

Spokes 36*a* which have become damaged during engine operation may be replaced and the assembly can be re-machined and then retained with a radial retaining ring having a smaller inner surface diameter than that of the previous radial retaining ring 48. The connecting bosses provide such re-machining possibilities without substantially affecting the outer case configuration.

Figure 5:
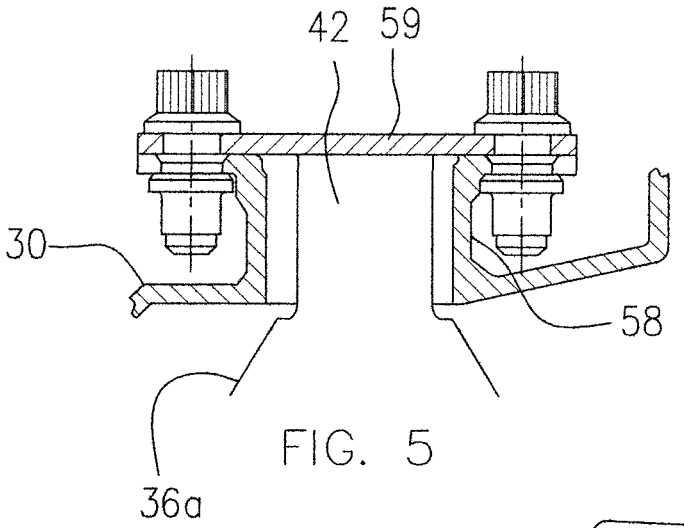
FIG. 5 is a partial schematic cross-sectional view of the radially-outer end portion of the spoke connected with the outer case according to another embodiment.
Figure 4:
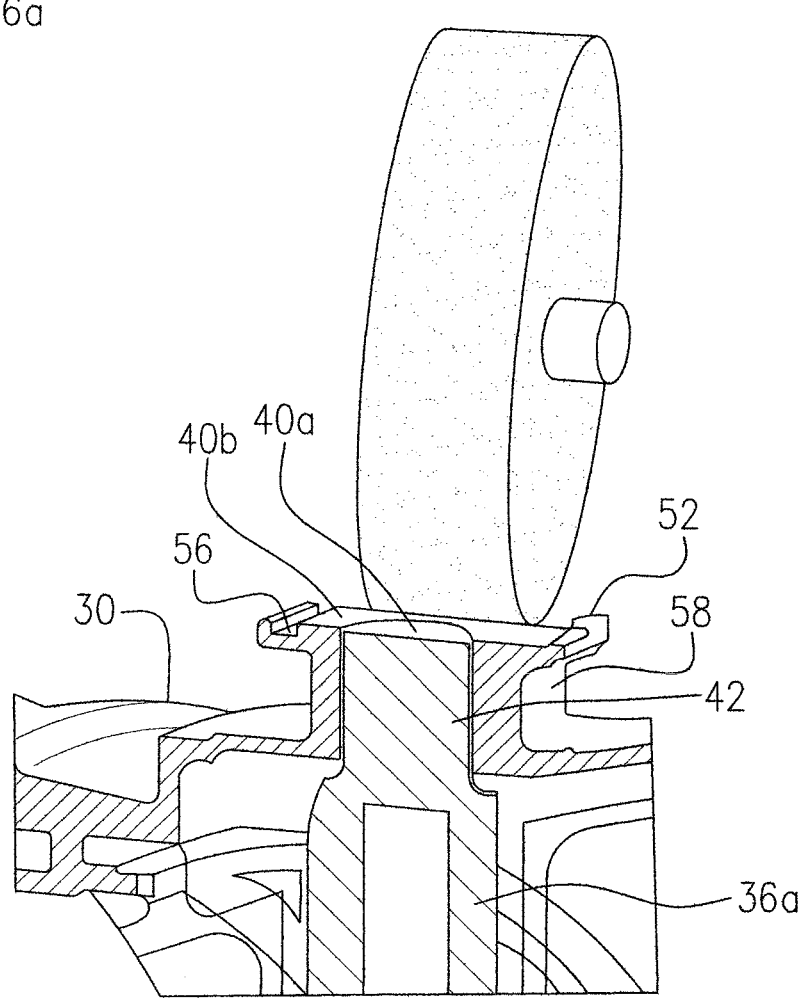
FIG. 4 is a partial perspective view of the substantial assembly of FIG. 3 in a machining operation, a front portion of the substantial assembly of the mid-turbine frame being cut off to show a radially-outer end portion of a spoke which is machined together with the outer case.

FIG. 5 shows an alternative retaining apparatus used in an embodiment employing a milling operation. The substantial MTF assembly retained on the fixture 32 as shown in FIG. 3, is not rotated in a milling operation and each of the commonly machined surfaces formed by the machined surface 40*a* of the respective spokes 36*a* and the machined surface 40*b* of the respective bosses 58 may be flat and may be machined individually one after another. Therefore, instead of a single radial retaining ring, a plurality of covering plates 59 may be placed against the respective commonly machined surfaces, in order to be in contact with both machined surfaces 40*a* and 40*b*. Each of the covering plates 59 may be secured to the top of the respective bosses 58 by, for example bolts and nuts (not numbered).

Figure 2:
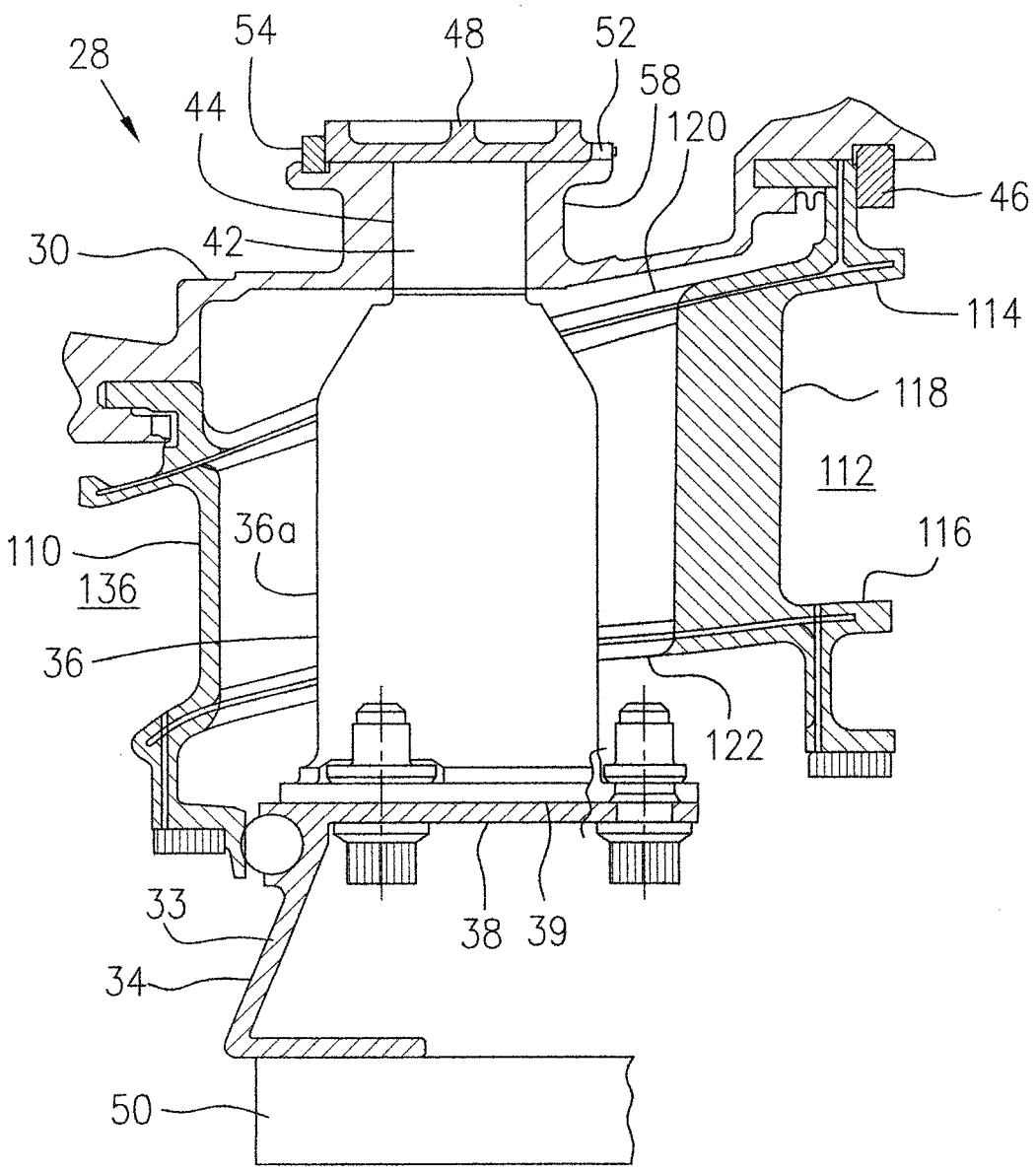
FIG. 2 is a partial cross-sectional view of the gas turbine engine of FIG. 1, showing a mid turbine frame thereof, according to one embodiment.
Figure 6:
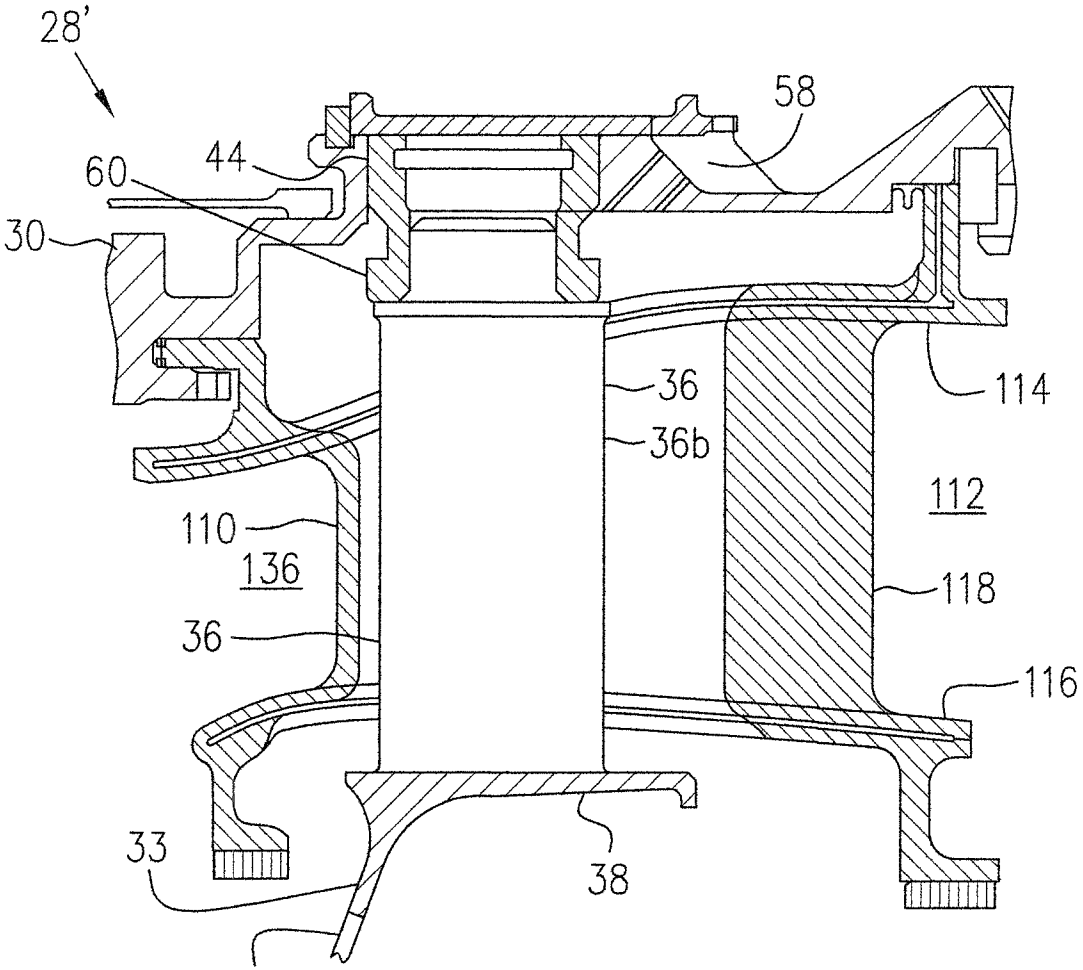
FIG. 6 is a partial cross-sectional view of the mid turbine frame (the bearing housing is not shown) according to another embodiment.

Referring to FIG. 6, an MTF 28' according to another embodiment is similar to the MTF 28 shown in FIG. 2 (the bearing housing 50 is not shown in FIG. 6). Like components and features are indicated by like numerals will not be redundantly described. The difference between the MTF 28' of FIG. 6 and the MTF 28 of FIG. 2 is that instead of a single spoke 36*a* in FIG. 2, the load transfer members 36 may each include a spoke body 36*b* having a radially-inner end (not numbered) and a radially-outer end (not numbered). The radially-inner end of each of the spoke bodies 36*b* may be affixed to the annular axial wall 38 of the inner case 34, for example by welding. Instead of an integrated radially-outer end portion 42 of the respective spokes 36*a*, each of the spoke bodies 36*b* may have a removable end extension 60 configured as a hollow spacer received on the radially-outer end of the spoke body 36*b*, opposite to the radially-inner end affixed to the inner case 34. The end extension 60 may rest on a shoulder of the spoke body 36*b* and may extend radially through one of the openings 44 defined in each of the bosses 58 of the outer case 30. Therefore, a commonly machined surface created by the machining operation is formed by a machined end surface of the end extension 60 (the spacer) and the machined top surface of the corresponding boss 58. The method for centering the bearing housing of the MTF of FIG. 6 is substantially similar to the method described above with reference to FIGS. 1-5. The removable end extension 60 of the load transfer member 36 in the MTF of FIG. 6 may provide further alternative assembly steps of the substantial MTF assembly held on the fixture 32 (not shown in FIG. 6).

Optionally, prior to machining the substantial MTF assembly in situ (i.e. while the substantial MTF assembly is being retained on the fixture) the bearing housing may be masked thoroughly to prevent debris from getting inside the bearing housing during the machining operation. After the machining operation is completed, the substantial MTF assembly held on the fixture may be pressure washed to remove debris before the retaining ring or separate retaining plates are installed.

The above-described embodiments simplify conventional MTF structures where stand-offs have to be measured and numbered, retaining covers have to be measured, numbered and then after calculating the differences, spacers also have to be ground and then numbered. It should also be noted that MTF structures are positioned in a hot area of gas turbine engines and therefore include cold spokes for load transfer and non-structural configuration of gas path and airfoils. All those configurations contribute to hot and cold radial stack-up which negatively affect the concentricity of the bearing housing within the outer case and the repeatability and stackability of the MTF assemblies. However, the machining of the substantial MTF assembly in situ substantially eliminates these tolerances.

The above description is meant to be exemplary only, and one skilled in the art will recognize that changes may be made to the embodiments described without departing from the scope of the described subject matter. For example, a turbofan gas turbine engine has been taken as an exemplary application of the described subject matter, however the described subject matter may also be applicable to other types of gas turbine engines. The method of centering the bearing housing with respect to an outer case of a mid turbine frame may also be applicable for the assembly of gas turbine engine structures which include at least co-axially positioned outer and inner cases connected by a plurality of circumferentially spaced load transfer members extending radially between the outer and inner cases. Such a method could include steps similar to those described with reference to the above described embodiments. Modifications which fall within the scope of the described subject matter will be apparent to those skilled in the art, in light of a review of this disclosure, and such modifications are intended to fall within the appended claims.

The invention claimed is:

1. A method for making an assembly of a gas turbine engine structure, the assembly including at least co-axially positioned annular outer and inner cases interconnected by a plurality of circumferentially spaced load transfer members extending radially between the outer and inner cases, the method comprising: (1) substantially forming the assembly of the gas turbine engine structure on a fixture by positioning the outer case and the inner case co-axially with each other on the fixture and affixing a radially-inner end of each of the load transfer members to the inner case while letting a radially-outer end portion of each of the load transfer members extend radially through one of a plurality circumferentially spaced openings defined in the outer case; (2) creating a plurality of commonly machined surfaces each provided by a machined end surface of one of the load transfer members flush with and surrounded by a machined surface of the outer case, by temporarily securing the substantially formed assembly on the fixture and machining the radially-outer end portion of the respective load transfer members exposed through the respective openings of the outer case and machining an area of the outer case surrounding each of the radially-outer ends; and then (3) securing the co-axial position of the outer and inner cases before the assembly is removed from the fixture by attaching a retaining device to the outer case to retain the respective commonly machined surfaces in place.

2. The method as defined in claim 1 wherein each of the load transfer members comprises a spoke having opposed ends, the opposed ends defining the respective radially-inner and radially-outer ends of each of the load transfer members.

3. The method as defined in claim 1 wherein each of the load transfer members comprises a spoke having opposed ends and a spacer removeably attached to one of the opposed ends of the spoke, the spacer forming the radially-outer end portion and providing the machined end surface of the load transfer member.

4. The method as defined in claim 1 wherein the machining operation in step (2) is conducted in a turning operation.

5. The method as defined in claim 1 wherein the machining operation in step (2) is conducted in a grinding operation.

6. The method as defined in claim 1 wherein the machining operation in step (2) is conducted in a milling operation.

7. The method as defined in claim 1 wherein the retaining device used in step (3) comprises a retaining ring being placed around the annular wall of the outer case, an inner surface of the retaining ring being in contact with the commonly machined surfaces to prevent radial movement between the load transfer members and the outer case.

8. The method as defined in claim 1 wherein the retaining device used in step (3) comprises a plurality of plates, each of the plates being securely attached to one of the commonly machined surfaces to prevent radial movement between each of the load transfer members and the outer case.

9. A method for centering a bearing housing during a mid-turbine frame (MTF) assembly procedure, the method comprising: (1) forming a substantial MTF assembly on a fixture by positioning at least an outer case, an inner case, a plurality of radial spokes and the bearing housing on the fixture, attaching the bearing housing to and supporting the bearing housing in the inner case, affixing a radially-inner end of each of the radial spokes to the inner case while letting a radially-outer end portion of each of the spokes extend radially through one of a plurality circumferentially spaced openings defined in the outer case to expose an outer end of the radially-outer end portion through the respective openings, and positioning the outer case co-axially with the bearing housing; (2) creating a plurality of commonly machined surfaces each formed with a machined end surface of one of the radial spokes flush with and surrounded by a machined surface of the outer case by temporarily securing the substantial MTF assembly on the fixture and machining the radially-outer end of the respective radial spokes exposed through the respective openings of the outer case and machining an area of the outer case surrounding each of the radially-outer ends; and (3) securing the co-axial position of the outer case and the bearing housing to form the MTF for installation in a gas turbine engine by attaching a retaining device to the outer case to retain the respective commonly machined surfaces in place when the substantial MTF assembly is on the fixture.

10. The method as defined in claim 9 wherein step (1) further comprises positioning an inter turbine duct (ITD) on the fixture such that the substantial MTF assembly includes the ITD positioned radially between the outer and inner cases, the ITD having a plurality of circumferentially spaced radial hollow struts interconnecting annular outer and inner duct walls, the spokes extending radially through the respective hollow struts and a through a plurality of openings defined in the respective outer and inner duct walls.

11. The method as defined in claim 9 wherein each of the spokes comprises opposed ends, one of the ends providing the machined end surface.

12. The method as defined in claim 9 wherein each of the spokes comprises a spoke body having opposed ends and a spacer removeably attached to one of the opposed ends to form the radially-outer end portion of the spoke and to provide the machined end surface of the spoke.

13. The method as defined in claim 9 wherein the outer case comprises a plurality of connecting bosses projecting radially outwardly, the openings defined in the outer case extending radially through the respective connecting bosses.

14. The method as defined in claim 9 wherein the retaining device used in step (3) comprises a radial retaining ring being placed around the outer case, an inner surface of the radial retaining ring being in contact with the commonly machined surfaces to prevent radial movement between the spokes and the outer case.

15. The method as defined in claim 9 wherein the retaining device used in step (3) comprises a radial retaining ring and an axial retaining ring being placed around the outer case, the radial retaining ring having an inner surface in contact with the commonly machined surfaces to prevent radial movement between the spokes and the outer case, and the axial retaining ring being engaged in an annular grove of the outer case to axially restrain the radial retaining ring in position.

16. The method as defined in claim 9 wherein the retaining device used in step (3) comprises a plurality of plates, each of the plates being securely attached to one of the commonly machined surfaces to prevent radial movement between each of the spokes and the outer case.

17. The method as defined in claim 9 further comprising a step of covering the bearing housing prior to step (2) to limit dirt entering into the bearing housing during the machining step.

18. The method as defined in claim 9 further comprising a step of cleaning dirt from the MTF assembly after step (2).

19. The method as defined in claim 10 wherein step (1) further comprises retaining the ITD in the outer case.

* * * * *